United States Patent [19]

LePage

[11] 4,392,284

[45] Jul. 12, 1983

[54] WATCHBAND ENDPIECE WITH CAPTURING BEAD

[75] Inventor: Joseph R. LePage, Watertown, Conn.

[73] Assignee: Timex Corporation, Waterbury, Conn.

[21] Appl. No.: 284,899

[22] Filed: Jul. 20, 1981

[51] Int. Cl.[3] ..... A44C 5/18

[52] U.S. Cl. ..... 24/265 B; 24/265 WS; 16/229; 16/380

[58] Field of Search ..... 24/265 B, 230, 255 BS, 24/265 WS, 265 R, 90 E, 90.5, 155 SD, 10 R; 29/160.6, 458; 63/21; 16/229, 380, 262, 263; 403/372, 225; 248/309 A, 316 E

[56] References Cited

U.S. PATENT DOCUMENTS

| | | | |
|---|---|---|---|
| 1,611,863 | 12/1926 | Hadley | 24/265 B |
| 1,713,533 | 4/1929 | Jones | 24/265 B |
| 1,819,225 | 8/1931 | Burman | 24/10 R |
| 2,468,985 | 5/1949 | Krotz | 403/225 |
| 2,705,643 | 4/1955 | Green | 403/227 |
| 3,123,882 | 3/1964 | Meyerson | 24/265 |

*Primary Examiner*—Gene Mancene
*Assistant Examiner*—David Tarnoff
*Attorney, Agent, or Firm*—William C. Crutcher; Joseph A. Biela

[57] ABSTRACT

A resilient capturing bead of silicone rubber is deposited and cured inside a tubular watch band endpiece and functions to frictionally engage a spring bar connector inserted in the endpiece, retaining the spring bar connector in proper position during assembly of the band and endpiece to a watchhead. The endpiece typically includes an access opening through which the capturing bead material is introduced into the endpiece.

8 Claims, 5 Drawing Figures

WATCHBAND ENDPIECE WITH CAPTURING BEAD

FIELD OF THE INVENTION

The present invention relates to an endpiece construction for a watch band and, in particular, to means for retaining a spring bar connector in a watch band endpiece. A method for assembling a spring bar connector into the endpiece is also disclosed.

BACKGROUND OF THE INVENTION

In the manufacture of wristwatches, one assembly step involves attaching the watch band or strap to the so-called watchhead which includes the assembled case or bezel, crystal, movement and caseback as well as other components. As is well known, the case or bezel of a majority of watches in use today includes a pair of spaced lugs on opposite sides between which the band or strap is attached by means of a conventional spring bar connector. As is also well known, the spring bar connector generally includes a cylindrical sheet metal tube in which spring-urged pintles are disposed and adapted to engage in holes provided in the watercase lugs. The construction of a typical spring bar connector is shown in the Pyne et. al. U.S. Pat. No. 4,270,201 issued May 26, 1981.

In assembling a metal watch band to the watchhead, the spring bar connector is first inserted into a tubular endpiece at the end of the band and then the endpiece is positioned between the lugs of the watchcase and the pintles of the spring bar housed in the endpiece are engaged in the lug holes. In the past, prior art workers have experienced difficulty in assembling the band to the watchhead as a result of uncontrolled spring bar connector movement or shifting in the endpiece of the band. This uncontrolled shifting makes manual or automated assembly of the band to the watchhead fraught with difficulty.

Prior art endeavours to minimize movement of the spring bar connector are illustrated in the Beucke U.S. Pat. No. 1,498,070 issued June 17, 1924, and the Jones U.S. Pat. No. 1,713,533 issued May 21, 1929. The Beucke patent discloses a tubular endpiece having parallel, longitudinal slots defining a strip which is bent inwardly into the tube so that the strip frictionally engages a connector pin therein. The Jones patent discloses a tubular endpiece having an inwardly-bent, circumferential tab that, in one embodiment, frictionally grips a connector pin in the endpiece.

Another somewhat similar technique for fixing a connector pin in a tubular element of a watch strap is illustrated in the Hadley U.S. Pat. No. 1,611,863 issued Dec. 21, 1926, which discloses forming a boss on the tubular element extending inwardly into a groove formed in the connector pin.

Endpiece constructions of various types are illustrated in the Speck et.al. U.S. Pat. No. 2,696,689 issued Dec. 14, 1934; the O'Larte et.al. U.S. Pat. No. 2,871,655 issued Feb. 3, 1959, and the Wyler et.al. U.S. Pat. No. 3,039,263 issued June 19, 1962.

SUMMARY OF THE INVENTION

Briefly stated, the present invention involves a tubular watch band endpiece having one or more capturing beads deposited inside the endpiece to retain a connector bar in position by frictional engagement therewith.

In one particular embodiment, the capturing bead comprises a resilient material such as silicone rubber which is deposited inside the tubular endpiece in a form resembling a "candy kiss" with a body portion attached to the inside of the tube and an elongated tail extending from the body position. The bead is cured in place inside the endpiece. When a connector bar is subsequently inserted, the capturing bead frictionally engages the bar to retain it in position, thereby minimizing unwanted movement or shifting of the bar during watchhead assembly as well as at other times. In a preferred embodiment, the tubular endpiece includes one or more access openings intermediate its ends through which the capturing bead material is deposited inside the endpiece.

DESCRIPTION OF PREFERRED EMBODIMENTS

Figure 1:
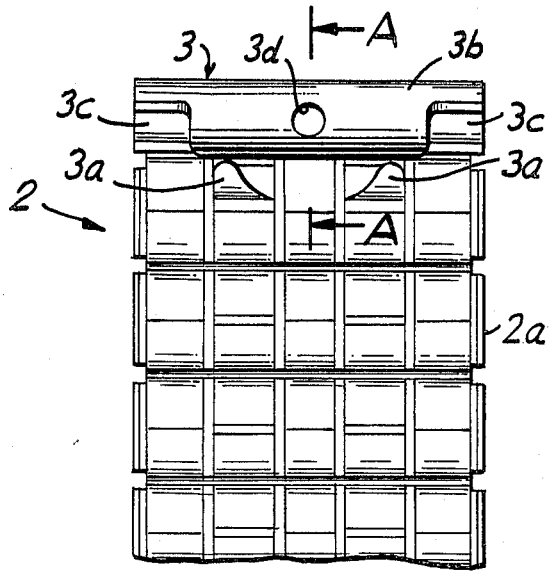
FIG. 1 is a partial rear view of a watch band and endpiece.
Figure 2:
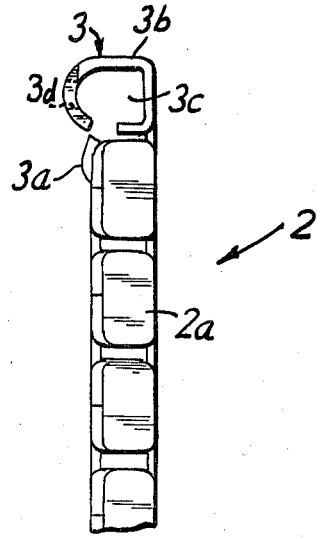
FIG. 2 is a side elevation of FIG. 1.

FIGS. 1 and 2 illustrate a watch band 2 comprised of individual links 2*a* and having a tubular endpiece 3 attached by bent tabs 3*a* to the end of the band. The individual links of the band are sheet metal bent into a typical box configuration. Other types of band and strap constructions may, of course, be employed, the invention not being limited to any particular type. As used herein, watch band is intended to include metal bands of the expansible or nonpansible type, mesh bands, plastic or leather straps as well as other types.

The tubular endpiece 3 is made of bent sheet metal such as stainless steel and includes the attachment tabs 3*a* already mentioned which secure the endpiece to the end of the watch band and a tubular portion 3*b* with open slots 3*c* provided adjacent the opposite ends of the endpiece to provide access to the spring bar connector after it is inserted in the endpiece. Intermediate the open ends is a circular access opening 3*d* providing access to the tube interior. A typical access opening has a diameter of 0.062 inch.

Figure 3:
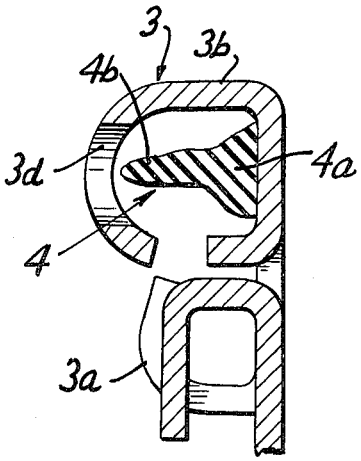
FIG. 3 is a partial cross-section through the watch band and endpiece along line A—A of FIG. 1.

Deposited inside the tubular endpiece is capturing bead 4 having a shape resembling a "candy kiss" with a body portion 4*a* and elongate tail portion 4*b*. A preferred material for the capturing bead is commercially available silicone rubber sold for example under the name RTV 108 sold by General Electric Corporation. The capturing bead is applied or deposited using a precision dispensing unit (model 300) sold by Tridak Div. of Indicon Inc., Brookfield Center, Connecticut in conjunction with a dispensing barrel and tip (#5110LL-B and #5118-B, respectively) sold by Electron Fusion Devices Inc, East Providence, Rhode Island. Of course, other dispensing systems can be used. The bead is deposited inside the endpiece by inserting the dispensing tip through the axcess opening 3*d* and applying the desired amount of silicone rubber into the endpiece. When deposited in this manner, the silicone rubber capturing bead assumes the "candy kiss" shape shown in FIG. 3. This shape is beneficial as explained hereinbelow. Thereafter, the capturing bead is allowed to cure for a minimum of one hour or for other suitable time periods to provide adhesion of the body portion 4a to the endpiece interior surface and to strengthen the bead while retaining resiliency.

Of course, a plurality of capturing beads may be deposited inside the endpiece to further enhance spring bar connector retention. For example, a capturing bead may be deposited inside the endpiece near each end thereof. Of course, the tubular endpiece may be provided with a plurality of access openings corresponding to the number of capturing beads to be deposited.

Figure 4:
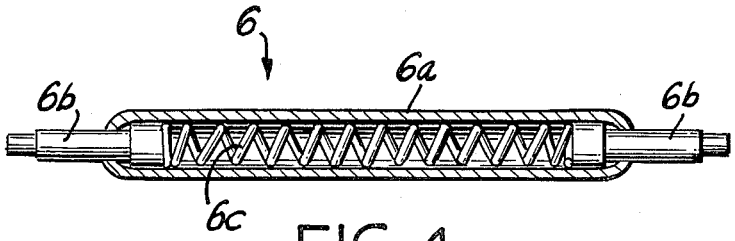
FIG. 4 is a cross-sectional view of a spring bar connector.
Figure 5:
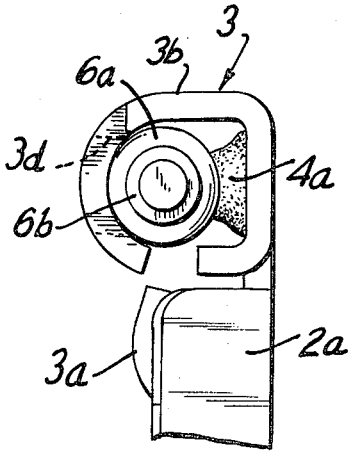
FIG. 5 is a partial end elevation showing the spring bar connector captured in the endpiece.

A conventional spring bar connector 6 shown in FIG. 4 is inserted into one of the open ends of the endpiece after curing of the capturing bead such that the cylindrical housing 6a thereof frictionally engages the capturing bead as shown in FIG. 5. In particular, the tail portion 4b of the bead is resiliently deformed or bent over on its side as the spring connector bar is inserted, frictionally contacting the cylindrical housing of the spring connector bar. Of course, the body portion 4a of the capturing bead also frictionally contacts the connector bar to assist in bar retention, FIG. 5.

Once the bar is retained inside the endpiece, the endpiece can be assembled to the lugs of a watchcase without fear of shifting or movement of the spring bar connector in the endpiece. For example, the pintles 6b of the spring bar connector are compressed against the bias of spring 6c, positioned between the watchcase lugs and then released to snap into holes in the lugs in conventional fashion. Of course, spring bar retention greatly facilitates automated or semi-automated assembly as well as manual assembly of the endpiece to the watchhead. Use of the resilient capturing bead is also advantageous from the standpoint that a defective spring bar connector can be removed easily from the endpiece while the integrity of the capturing bead is maintained for recapturing the replacement spring connector bar.

It will be apparent that the configuration, size and other features of the capturing bead can be varied as desired to achieve the required positive spring bar retention in the endpiece. Other materials may be used as the capturing bead material. Well-known elastomers, rubbers and the like are examples of potentially useful materials. Of course, the endpiece can be of any desired shape and configuration.

While certain preferred embodiments of the present invention have been illustrated, it will be apparent to those skilled in the art that various changes and modifications may be made therein without departing from the spirit and scope of the invention as covered in the appended claims. 9n

I claim:

1. In a watch band endpiece construction, the combination of:

(a) tubular endpiece member having open ends and an access opening intermediate the ends, (b) a resilient capturing bead deposited inside said endpiece member opposite the access opening therein, and (c) a connector bar member retained inside said endpiece member by frictional engagement with said capturing bead.

2. The endpiece construction of claim 1 wherein the capturing bead has the configuration of a "candy kiss" with a body portion adhered to the inside of the endpiece member and a tail portion extending therefrom and bent over by said connector bar.

3. The endpiece construction of claim 1 wherein the capturing bead is silicone rubber.

4. A watch band endpiece for receiving and retaining a connector bar, comprising:

(a) a tubular endpiece member with open ends and an axcess opening intermediate the ends, and (b) a resilient capturing bead deposited inside the tubular housing opposite the access opening and adapted to frictionally engage and retain the connector bar when the bar is inserted into said tubular housing.

5. The endpiece construction of claim 4 wherein the capturing bead has the configuration of a "candy kiss" with a body portion adhered to the inside of the endpiece member and a tail portion extending therefrom toward the access opening.

6. A method for assembling a connector bar in a tubular watch band endpiece having a circular access intermediate between the opposite ends of said endpiece, comprising:

(a) depositing a capturing bead made of resilient material inside the tubular endpiece through said circular access, and (b) inserting the connector bar into the tubular endpiece such that said capturing bead frictionally contacts the connector bar and retains it in position preventing movement of said connector bar.

7. The method of claim 6 including the additional step of allowing the capturing bead to adhere in place to the inside of the endpiece before the connector bar is inserted.

8. In a watchband endpiece construction, the combination of:

(a) a tubular endpiece member with open ends and an access opening intermediate said open ends, (b) a capturing bead made of resilient silicone rubber material deposited inside said endpiece member through said access opening and cured inside said endpiece member, said capturing bead having the configuration of a "candy kiss" with a body portion attached to the inside of said endpiece member and an elongate tail portion extending therefrom, and (c) a connector bar member retained inside said endpiece member by frictional engagement with said elongate tail portion of said capturing bead.

* * * * *